US007819273B2

(12) United States Patent
Yang et al.

(10) Patent No.: US 7,819,273 B2
(45) Date of Patent: Oct. 26, 2010

(54) LIQUID NATURAL GAS TANK WITH WRINKLED PORTION AND SPACED LAYERS AND VEHICLE WITH THE SAME

(75) Inventors: Young Myung Yang, Ansan-si (KR); Ihn Soo Yoon, Incheon (KR); Young Chul Yang, Gunpo-si (KR); Young Kyun Kim, Gwangmyeong-si (KR)

(73) Assignee: Korea Gas Corporation (KR)

( * ) Notice: Subject to any disclaimer, the term of this patent is extended or adjusted under 35 U.S.C. 154(b) by 700 days.

(21) Appl. No.: 11/677,983

(22) Filed: Feb. 22, 2007

(65) Prior Publication Data

US 2007/0246473 A1 Oct. 25, 2007

(30) Foreign Application Priority Data

Apr. 20, 2006 (KR) ..... 10-2006-0035743

(51) Int. Cl.
*B65D 81/38* (2006.01)
*F17C 1/00* (2006.01)

(52) U.S. Cl. ..... 220/592.26; 220/560.07; 220/560.15

(58) Field of Classification Search ..... 114/74 A; 220/23.89, 560.04, 560.05, 560.07, 560.1, 220/560.15, 592, 592.25, 592.26
See application file for complete search history.

(56) References Cited

U.S. PATENT DOCUMENTS 2,006,331 A * 6/1935 Swearingen ..... 220/560.05
2,100,895 A * 11/1937 Austin ..... 220/567.2
2,545,686 A * 3/1951 Collins ..... 220/560.05
3,299,598 A 1/1967 Alleaume
3,302,359 A 2/1967 Alleaume
3,331,525 A 7/1967 Coehn
3,339,003 A 8/1967 Cessna
3,341,049 A 9/1967 Forman et al.
3,399,800 A 9/1968 Gilles
3,403,651 A 10/1968 Gilles
3,425,583 A * 2/1969 Bridges ..... 220/560.05
3,428,205 A * 2/1969 Basile et al. ..... 220/560.07

(Continued)

FOREIGN PATENT DOCUMENTS

JP 57-027600 U 2/1982

(Continued)

OTHER PUBLICATIONS

Notice of Allowance for related U.S. Appl. No. 11/119,216 dated Jun. 22, 2009.

(Continued)

*Primary Examiner*—Mickey Yu
*Assistant Examiner*—Ned A Walker
(74) *Attorney, Agent, or Firm*—Knobbe Martens Olson & Bear, LLP

(57) ABSTRACT

Disclosed is a liquefied natural gas storage tank having an insulation structure which comprises an insulation wall installed on an inner wall of the tank. The tank has interior wall installed over the insulation wall. The interior wall has a first layer which directly contacts with liquefied natural gas and a second layer disposed between the first layer and the insulation wall. A plurality of anchor structures are installed on the inner wall of the tank through the insulation wall to support the interior wall.

24 Claims, 4 Drawing Sheets

U.S. PATENT DOCUMENTS

| | | | | | |
|---|---|---|---|---|---|
| 3,485,409 | A | | 12/1969 | Becker | |
| 3,498,249 | A | | 3/1970 | Jones | |
| 3,507,242 | A | * | 4/1970 | Ulbricht | 114/74 R |
| 3,721,362 | A | * | 3/1973 | Bridges et al. | 220/560.06 |
| 3,782,581 | A | | 1/1974 | Beazer | |
| 3,800,970 | A | * | 4/1974 | Jackson | 220/560.08 |
| 3,811,593 | A | | 5/1974 | Bridges et al. | |
| 3,830,396 | A | * | 8/1974 | Jackson | 220/560.07 |
| 3,871,319 | A | | 3/1975 | Turner | |
| 3,896,961 | A | | 7/1975 | Guilhem et al. | |
| 3,974,935 | A | * | 8/1976 | Ffooks | 220/560.05 |
| 4,003,174 | A | | 1/1977 | Kotcharian | |
| 4,021,982 | A | | 5/1977 | Kotcharian | |
| 4,057,943 | A | * | 11/1977 | Lienhard | 52/126.6 |
| 4,065,019 | A | | 12/1977 | Letourneur et al. | |
| 4,099,649 | A | * | 7/1978 | Guilhem et al. | 220/560.07 |
| 4,105,819 | A | | 8/1978 | Kotcharian | |
| 4,155,482 | A | | 5/1979 | Swaney | |
| 4,225,054 | A | * | 9/1980 | Jean | 220/592.2 |
| 4,374,478 | A | * | 2/1983 | Secord et al. | 73/863.31 |
| 4,378,403 | A | | 3/1983 | Kotcharian | |
| 4,561,292 | A | * | 12/1985 | Pugnale et al. | 73/49.2 |
| 4,676,093 | A | * | 6/1987 | Pugnale et al. | 73/49.2 |
| 4,747,513 | A | | 5/1988 | Betille et al. | |
| 4,781,777 | A | * | 11/1988 | Pugnale et al. | 156/187 |
| 5,269,247 | A | | 12/1993 | Jean | |
| 5,368,670 | A | * | 11/1994 | Kauffman | 156/171 |
| 5,447,112 | A | | 9/1995 | Jean | |
| 5,450,806 | A | | 9/1995 | Jean | |
| 5,501,359 | A | | 3/1996 | Chauvin et al. | |
| 5,531,178 | A | * | 7/1996 | Abe et al. | 114/74 A |
| 5,586,513 | A | | 12/1996 | Jean et al. | |
| 5,727,492 | A | * | 3/1998 | Cuneo et al. | 114/74 A |
| 6,035,795 | A | | 3/2000 | Dehellemmes et al. | |
| 6,145,690 | A | | 11/2000 | Dehellemmes et al. | |
| 6,199,497 | B1 | | 3/2001 | Dehellemmes et al. | |
| 6,374,761 | B1 | | 4/2002 | Dehellemmes | |
| 6,378,722 | B1 | | 4/2002 | Dehellemmes | |
| 6,551,024 | B1 | * | 4/2003 | Berg et al. | 405/54 |
| 6,626,319 | B2 | * | 9/2003 | Miller et al. | 220/560.07 |
| 6,675,731 | B2 | | 1/2004 | Dehellemmes | |
| 6,971,537 | B2 | * | 12/2005 | Enright, Jr. | 220/560.08 |
| 7,171,916 | B2 | | 2/2007 | Yang et al. | |
| 7,204,195 | B2 | * | 4/2007 | Yang et al. | 114/74 A |
| 7,325,288 | B2 | * | 2/2008 | Yang et al. | 29/455.1 |
| 7,469,650 | B2 | * | 12/2008 | Jordan et al. | 114/74 A |
| 2003/0000949 | A1 | | 1/2003 | Dehellemmes | |
| 2003/0066834 | A1 | * | 4/2003 | Enright, Jr. | 220/9.4 |
| 2006/0117566 | A1 | | 6/2006 | Yang et al. | |
| 2006/0118018 | A1 | | 6/2006 | Yang et al. | |
| 2006/0131304 | A1 | | 6/2006 | Yang et al. | |
| 2007/0028823 | A1 | | 2/2007 | Yang et al. | |

FOREIGN PATENT DOCUMENTS

| | | | | |
|---|---|---|---|---|
| JP | 2000-38190 | A | | 2/2000 |
| JP | 2000-079987 | A | | 3/2000 |
| JP | 2001-122386 | A | | 5/2001 |
| JP | 2001-158395 | A | | 6/2001 |
| JP | 2002-181288 | A | | 6/2002 |
| KR | 10-2000-0011346 | A | | 2/2000 |
| KR | 10-2000-0011347 | A | | 2/2000 |
| KR | 10-2001-0050440 | A | | 6/2001 |
| KR | 499711 | B | * | 7/2005 |
| WO | 89/09909 | | | 10/1989 |

OTHER PUBLICATIONS

Notice of Allowance for related U.S. Appl. No. 11/119,217 dated Jan. 4, 2010.

Notice of Allowance for related U.S. Appl. No. 11/119,219 dated Oct. 3, 2006.

Notice of Allowance for related U.S. Appl. No. 11/119,268 dated Sep. 13, 2007.

Notice of Allowance for related U.S. Appl. No. 11/502,296 dated Dec. 5, 2006.

Supplemental Notice of Allowance for related U.S. Appl. No. 11/119,268 dated Oct. 3, 2007.

Supplemental Notice of Allowance for related U.S. Appl. No. 11/119,268 dated Nov. 1, 2007.

* cited by examiner

LIQUID NATURAL GAS TANK WITH WRINKLED PORTION AND SPACED LAYERS AND VEHICLE WITH THE SAME

CROSS-REFERENCE TO RELATED APPLICATION

This application claims priority to and the benefit of Korean Patent Application No. 10-2006-0035743, filed Apr. 20, 2006, the disclosure of which is incorporated herein by reference in its entirety.

BACKGROUND

1. Field

The present invention relates to a liquefied natural gas (LNG) storage tank, and more particularly, an LNG storage tank having an improved insulation structure.

2. Discussion of the Related Technology

In general, liquefied natural gas (LNG) is obtained by causing natural gas, one of fossil fuels, to be liquefied. An LNG storage tank is classified into a ground storage tank, which is installed on the ground or buried in the ground according to installation positions, and a mobile storage tank, which is mounted on transportation means such as vehicles and ships. The aforementioned LNG is stored in a cryogenic state and is explosive when it is exposed to shock. Thus, the LNG storage tank should be constructed such that shock resistance and liquid-tight characteristics thereof can be firmly maintained.

Japanese Patent Laid-Open Publication No. 2002-181288 discloses a liquefied natural gas storage tank including an outer tank made of concrete, insulation covering an inner surface of the outer tank, and two membranes.

This section is to provide a general background information, and does not constitute an admission of prior art.

SUMMARY

One aspect of the invention provides a liquid tank, which comprises: an interior wall defining a space for containing liquid, the interior wall comprising a wrinkled portion and a non-wrinkled portion, wherein each of the wrinkled portion and the non-wrinkled portion comprises a first layer and a second layer opposing the first layer, wherein the first layer is configured to contact the liquid; an exterior wall; and an intermediate wall interposed between the interior wall and the exterior wall; wherein the non-wrinkled portion further comprises a substance contacting both the first and second layers, and wherein the substance is substantially hard such that the first and second layers of the non-wrinkled portion substantially maintain a distance therebetween; and wherein the wrinkled portion comprises a first wrinkle in the first layer and a second wrinkle in the second layer, wherein the first and second wrinkles are opposing each other.

In the foregoing liquid tank, the first and second layers may not contact each other. The first wrinkle may be configured to allow deformation of the first layer. The first layer may be configured to shrink, upon contacting the liquid, and wherein the first wrinkle may be configured to be stretched when the first layer is shrunk. The substance may be movable relative to at least one of the first layer and the second layer while contacting the first layer and the second layer. The wrinkled portion may be substantially free of a substance between the first and second wrinkles that inhibits deformation of the wrinkled portion. The first and second layers may be generally parallel in the first and second wrinkles. The first wrinkle may substantially receive the second wrinkle. The wrinkled portion may be elongated, wherein the first and second wrinkles may extend in a longitudinal direction of the wrinkled portion. The first and second layers may be generally inversely curved in the first and second wrinkles. The first layer of the wrinkled portion and the first layer of the non-wrinkled portion may be sealed in a liquid-tight manner, wherein the second layer of the wrinkled portion and the second layer of the non-wrinkled portion may be sealed in a liquid-tight manner.

Still in the foregoing liquid tank, the interior wall may further comprise a coupler sealed with both the first layer and the second layer in a liquid-tight manner. The wrinkled portion may be sealed with the coupler in a liquid-tight manner, wherein the wrinkled portion comprises a spacer between the first and second layers thereof where the wrinkled portion is coupled to the coupler. The coupler may be configured to contact the liquid. The first layer may extend over the coupler, wherein the second layer may be lacking where the coupler is formed. The interior wall may further comprise at least one additional wrinkled portion, each of which is coupled with the coupler in a liquid-tight manner. The liquid tank may comprise an anchor contacting and secured to both the interior wall and the exterior wall, wherein the anchor may contact and be secured to the coupler of the interior wall. The intermediate wall may comprise an anchored portion and a non-anchored portion, wherein the anchored portion may contact the anchor and be integral with the anchor, wherein the non-anchored portion may not contact the anchor. The anchored portion may contact and be secured to the coupler of the interior wall and the exterior wall. The non-anchored portion may be slidably inserted between the interior wall and the exterior wall. The non-anchored portion may not be fixed either of the interior wall and the exterior wall. The substance may be configured to substantially insulate heat transfer between the first layer and the second layer. The exterior wall may comprise a structure of a ship, and wherein the liquid tank may be integrated with the ship. The liquid tank may be integrated with a ground transportation vehicle.

Another aspect of the invention provides a method of making the foregoing liquid tank, which comprises: providing an exterior wall; providing an intermediate wall; and providing an interior wall, wherein the intermediate wall is interposed between the interior wall and the exterior wall, wherein the interior wall comprises a wrinkled portion and a non-wrinkled portion, wherein each of the wrinkled portion and the non-wrinkled portion comprises a first layer and a second layer opposing the first layer, and wherein the non-wrinkled portion further comprises a substance contacting both the first and second layers such that the first and second layers of the non-wrinkled portion substantially maintain a distance therebetween; and wherein the wrinkled portion comprises a first wrinkle in the first layer and a second wrinkle in the second layer, and wherein the first and second wrinkles are opposing each other. In the foregoing method, providing the interior wall may comprise placing the first layer, the substance and the second layer, wherein the substance may be interposed between the first layer and the second layer, and wherein the substance may not fixed to the first or second layer.

Yet Another aspect of the present invention provides a liquefied natural gas storage tank having an improved insulation structure and a method of manufacturing the same, wherein sealing reliability can be increased by simplifying structures of insulation and sealing wall and an assembling mechanism between the walls and improving the assembling work and a time taken to construct the tank can be reduced by simplifying the manufacturing structure and process.

A further aspect of the present invention provides a liquefied natural gas storage tank having an improved insulation structure, which comprises an insulation wall installed on an inner wall of the tank, sealing wall having a plurality of sealing wall layers installed over an upper surface of the insulation wall and contacting liquefied natural gas, and a plurality of anchor structures installed on the inner wall of the tank through the insulation wall to support the sealing wall layers. In particular, the sealing wall layers have a close dual-layer sealing structure and the sealing wall layers are spaced apart from each other.

The interior sealing wall may have a multiple-layer structure in which at least two layers are formed. Further, the insulation wall may have a single-layer structure. Preferably, the insulation wall is composed of a plurality of modules which in turn are coupled with one another to form an insulation wall layer. Further, each of the modules may be formed with insulation and a board attached to an upper side and/or a lower side of the insulation. Preferably, each of the modules is formed with a corner module installed at a corner portion of the tank and a planar module installed at a planar portion of the tank. Further, the corner module may be bonded to the tank by means of an adhesive. Preferably, the planar module can be slid between the sealing wall and the outer wall of the tank.

Each of the anchor structures may comprise an anchor support rod mechanically supported onto the inner wall of the storage tank and an anchor insulation wall surrounding the anchor support rod. Alternatively, each of the anchor structures may comprise an anchor support rod secured to the inner wall of the storage tank through welding and an anchor insulation wall surrounding the anchor support rod. Preferably, the anchor support rod is formed with an upper cap at an upper side thereof and the sealing wall layers are welded to the upper cap. Further, the sealing wall may have a dual-layer structure and enclose a supporting board for allowing a distance between the sealing wall layers to be kept constant. Preferably, the supporting board is formed of a material selected from the group consisting of plywood, polyurethane foam (or reinforced polyurethane foam), and a composite material in which plywood is bonded to at least one of top and bottom surfaces of polyurethane foam (or reinforced polyurethane foam). More preferably, the upper cap includes a step portion corresponding to a height of the two layers of the interior sealing wall and the corresponding sealing wall layer is coupled with the step portion through welding.

A still further aspect of the present invention provides a method of manufacturing a liquefied natural gas storage tank having an improved insulation structure, which comprises the steps of installing an insulation wall onto an inner wall of the tank, and installing multi-layer sealing wall onto an upper surface of the insulation wall, the sealing wall contacting liquefied natural gas, wherein the multi-layer sealing wall is supported by a plurality of anchor structures installed onto the inner wall of the storage tank through the insulation wall and each of the sealing wall layers is spaced apart from one another. In the method for manufacturing a storage tank, the features in the aforementioned storage tank can be included.

BRIEF DESCRIPTION OF THE DRAWINGS

The above and other aspects, features and advantages of the present invention will become apparent from the following description of embodiments given in conjunction with the accompanying drawings, in which.

DETAILED DESCRIPTION OF EMBODIMENTS

Hereinafter, various embodiments of the present invention will be described in detail with reference to the accompanying drawings.

Figure 1:
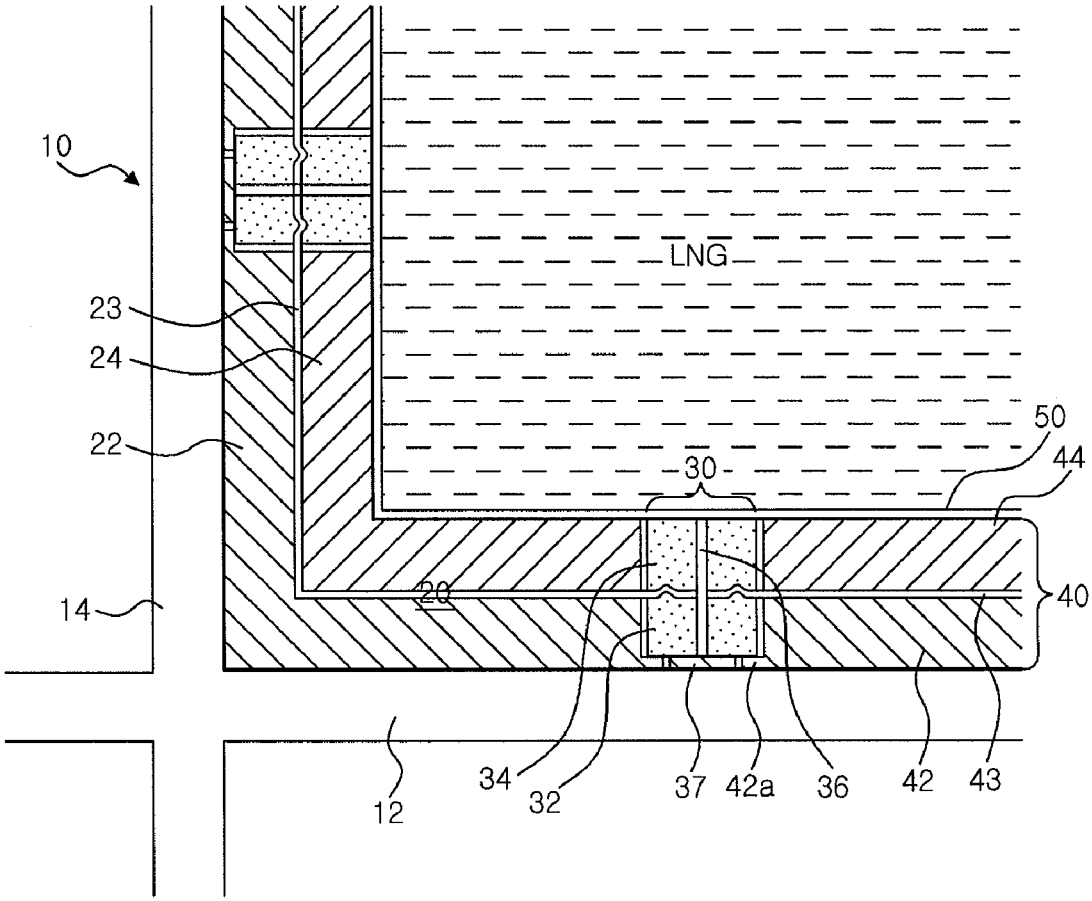
FIG. 1 is a perspective view showing a portion of an exemplary liquefied natural gas storage tank.

FIG. 1 is a perspective view showing a portion of an exemplary liquefied natural gas storage tank. In the exemplary LNG storage tank 10, second insulation walls 22 and 42 and first insulation walls 24 and 44 are sequentially installed on a floor surface of a ship's hull, second sealing walls 23 and 43 are installed between the second insulation wall 22 and the first insulation wall 24 and between the second insulation wall 42 and the first insulation wall 44, respectively, to seal spaces defined between the first and second insulation walls. Further, a first sealing wall 50 is installed on the first insulation walls 24 and 44.

The LNG storage tank 10 constructed as described above comprises corner structures 20 installed at inner corners of the tank, anchor structures 30 installed on a floor surface of the tank at regular intervals, and planar structures 40 each being interposed and slidably installed between the corner structures 20 or between the anchor structures 30. At this time, each of the corner structures 20, the anchor structures 30 and the planar structures 40 is beforehand manufactured as a unit module and then assembled in the storage tank 10. Further, the first sealing wall 50 is installed on the structure to seal the insulation wall in a liquid-tight manner, so that a space capable of storing liquefied natural gas (LNG) therein can be defined within an inner space of the tank.

Referring to FIG. 1, the LNG storage tank 10 will be described hereinafter. The corner structures 20, the anchor structures 30 and the planar structures 40 comprise the first insulation walls 24, 34 and 44, the second insulation walls 22, 32 and 42 and the second sealing wall 23 and 43, respectively, and are defined as the insulation wall structures 20, 30 and 40. In each of the insulation structures 20, 30 and 40, contact surfaces between the second sealing wall and insulation walls are bonded to each other by an adhesive such that the walls can be integrally formed with one another. In general, each of the second insulation walls 22 and 42 is composed of polyurethane foam (an insulating material) and a board attached to the lower side of the polyurethane foam. Further, each of the first insulation walls 24 and 44 is composed of polyurethane foam and a board attached to the upper side of the polyurethane foam by an adhesive. In addition, the first sealing wall is installed on the first insulation walls 24, 34 and 44 and welded to the anchor structure 30. Further, a flange 42*a* larger than the second insulation wall 42 is formed at a lower end of the second insulation wall 42 of the planar structure 40. The flange 42*a* is inserted in a groove formed at a lower end of the anchor structure 30 such that it can be slightly slid therein.

In the illustrated storage tank, each of the anchor structures 30 comprises an anchor support rod 36, a fixing member 37 located at the lower side, a second anchor insulation wall 32 and a first anchor insulation wall 34. Further, the second sealing walls 23 and 43 lie between the first and second anchor insulation walls 34 and 32. One end of the anchor support rod 36 is connected to the first sealing wall 50 while the other end is connected to an inner wall 12 of the ship's hull through the fixing member 37.

Furthermore, the first sealing wall 50 is welded to the upper end of the anchor support rod 36 such that the first sealing wall 50 can be coupled with the anchor structure 30. In addition, the anchor structure 30 is located at a connecting point of the adjacent planar structures 40 to connect the planar structures to each other, and the planar structures 40 are fixed to the inner wall 12 or a bulkhead 14 of the hull constituting the storage tank 10. Further, the fixing member 37 of the anchor structure 30 is installed around the anchor support rod 36.

Alternatively, dual-layered sealing wall may be used in a storage tank. The dual-layered sealing wall has an inner layer membrane in direct contact into a liquefied natural gas and an outer layer membrane in direct contact with the exterior of the inner layer membrane, to thereby improving the safety. In this configuration, however, since the inner and outer layer membranes closely contact each other, there may be problems in that friction may occur between the inner and outer layer membranes in a case where there is a motion of the liquefied natural gas in the storage tank and that the breakage of one membrane may directly result in the breakage of the other membrane. Therefore, such an exemplary dual-layered sealing wall may not be employed in the storage tank installed in a ship in which the liquefied natural gas can be moved.

In a liquefied natural gas storage tank according to an embodiment, liquefied natural gas (LNG) is stored in a high pressure and extremely low temperature state. To this end, the LNG storage tank is constructed such that shock resistance and liquid-tight characteristics are firmly maintained. The LNG storage tank mounted to an automobile or ship, in which cargo is movable, is different from the ground storage tank with little motion in that suitable countermeasures may be prepared against mechanical stress due to the cargo motion in the storage tank. However, the LNG storage tank mounted to a ship to which the countermeasures against the mechanical stress are provided can also be applied to the ground storage tank. Thus, the configuration of an LNG storage tank mounted to a ship will be described herein by way of example.

Figure 2:
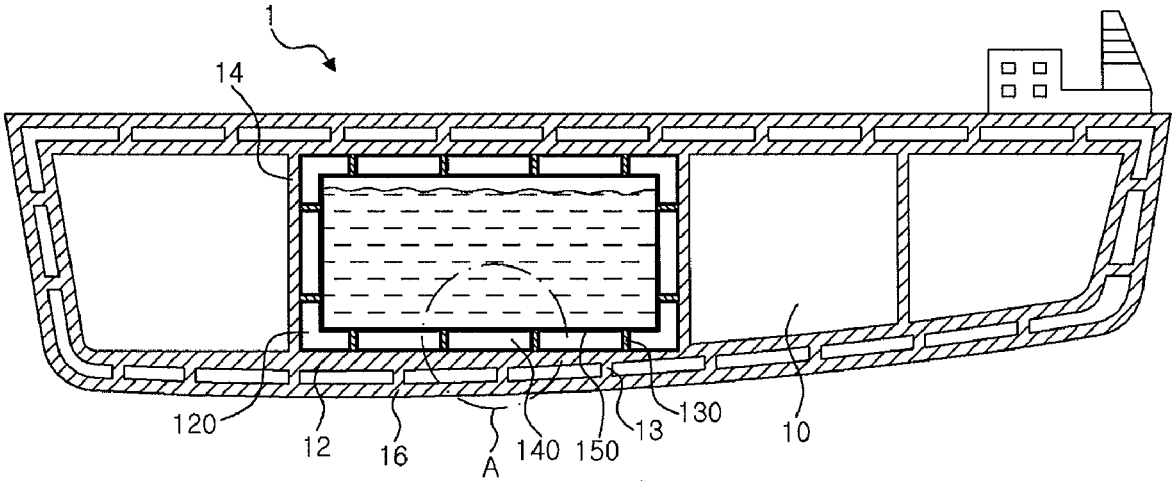
FIG. 2 is a sectional view of an exemplary ship in which the liquefied natural gas storage tank is installed according to an embodiment of the present invention.

FIG. 2 is a sectional view of an exemplary ship in which an LNG storage tank according to an embodiment of the present invention is installed. Here, for easy understanding, the module is more enlarged and shown in FIG. 2 than in the actual liquefied natural gas storage tank. It should be understood that a larger number of storage tanks are partitioned and connected with one another in the actual ship.

As shown in FIG. 2, the LNG storage tank according to an embodiment of the present invention may be installed in a ship 1. The ship 1 comprises a hull having a dual-layer structure of an outer wall 16 defining an external appearance and an inner wall 12 formed within the outer wall 16. In the ship 1, the inner and outer walls 12 and 16 are integrally formed with each other through connecting ribs 13. Alternatively, the ship 1 may comprise a hull having a single structure in which the inner wall 12 is not installed may be constituted. Meanwhile, the upper side of the ship can be formed into a single deck and an external appearance of the upper side of the ship can vary according to the dimension or storage capacity of the ship 1. A space defined by the inner wall 12 can be divided by one or more bulkheads 14. A cofferdam may be defined by the bulkhead 14.

Each inner space can be formed into a storage tank 10 for receiving and storing cryogenic liquid such as liquefied natural gas. An embodiment of the present invention is illustrated in such a manner that the storage tank 10 is installed at the second space from the left in the ship 1. Here, an interior wall or sealing wall 150 is provided to seal liquefied natural gas stored in the storage tank 10 in a liquid-tight manner. The sealing wall 150 can contact liquefied natural gas and formed with a corrugated portion on the sealing wall to cope with change in temperature according to the loading and unloading of cryogenic liquefied natural gas. In an embodiment, the sealing wall 150 is connected to the inner wall 12 or the bulkhead 14 of the ship 1 by means of a plurality of anchor structures 130. Accordingly, the sealing wall 150 cannot be freely moved with respect to the ship's hull. Further, insulation wall structures 120, 130 and 140 serving as a module for forming a layer of the insulation wall are placed between the sealing wall 150 and the inner wall 12 of the hull constituting the tank 10. The anchor structure 130 will be illustrated as one of the insulation wall modules. The insulation wall structures 120, 130 and 140 are placed between the sealing wall 150 and the inner wall 12 or bulkhead 14 of the hull to define an insulation wall for insulating the storage tank 10 from the outside. In addition, the insulation wall structures 120, 130 and 140 include the corner structures 120 placed at the corner, the anchor structures 130 installed on the inner wall of the hull at regular intervals and the planar structures 140 installed between the corner structures 120 or between the anchor structures 130, each of which is formed into a module. As described above, the sealing wall 150 are mainly supported by the anchor structures 130, and the planar structures 140 support only weight of the liquefied natural gas applied to the sealing wall and are not in a direct coupling relationship with the anchor structures.

Figure 3:
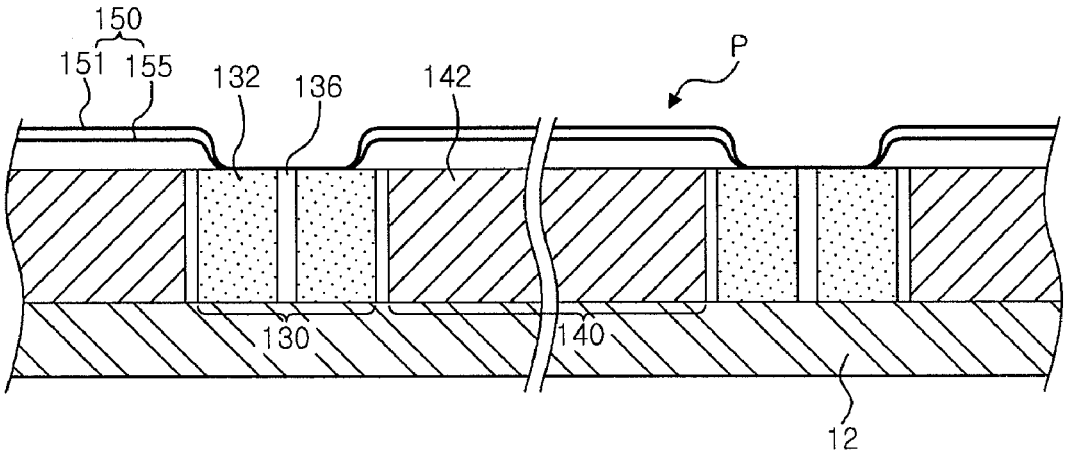
FIG. 3 is an enlarged view of an "A" portion in FIG. 2.

FIG. 3 is an enlarged view of an "A" portion of FIG. 2. Referring to this figure, the insulation structures 130 and 140 installed on the inner wall 12 of the storage tank 10 include the planar structures 140 installed on planar sections of the inner wall of the tank and the anchor structures 130 each installed between the adjacent planar structures 140. Each of the anchor structures 130 is installed on the inner wall 12 or bulkhead 14 of the storage tank 10 and fixed by an anchor support rod 136 penetrating through the anchor structure 130. Further, the planar structure 140 is inserted between the anchor structures 130 or between the corner structures 120 (in FIG. 2), and thus, the planar structure is also installed on the inner wall 12 of the tank 10 by means of a plurality of connecting means (not shown).

Further, the sealing wall 150 contacting with liquefied natural gas are installed on the insulation structures 130 and 140. The sealing wall 150 have a dual-layer structure comprising a first sealing wall layer or first layer 151 which directly contact the liquefied natural gas and a second sealing wall layer or second layer 155 which is installed below the first sealing wall layer 151. The first sealing wall layer 151 and the second sealing wall layer 155 are disposed such that they are spaced from each other by a predetermined height.

In addition, the sealing wall 150 are formed with a plurality of corrugated portions P (convex portions in the drawing) to prevent the sealing wall layers from being damaged when it is contracted and expanded. The corrugated portions P are contracted or expanded by the temperature change at the time of loading and unloading the liquefied natural gas to prevent the damage of the sealing wall 150 caused by thermal deformation applied to the sealing wall. Further, the sealing wall layers of the sealing wall 150 are fixed to an end of the anchor support rod 136 of the anchor structure 130 through a welding process.

Although it has been illustrated in FIG. 3 that the sealing wall 150 have a dual-layer structure comprising the first and second sealing wall layers 151 and 155, it is possible to form the sealing wall with the multiple-layer structure including three or more layers.

Figure 4:
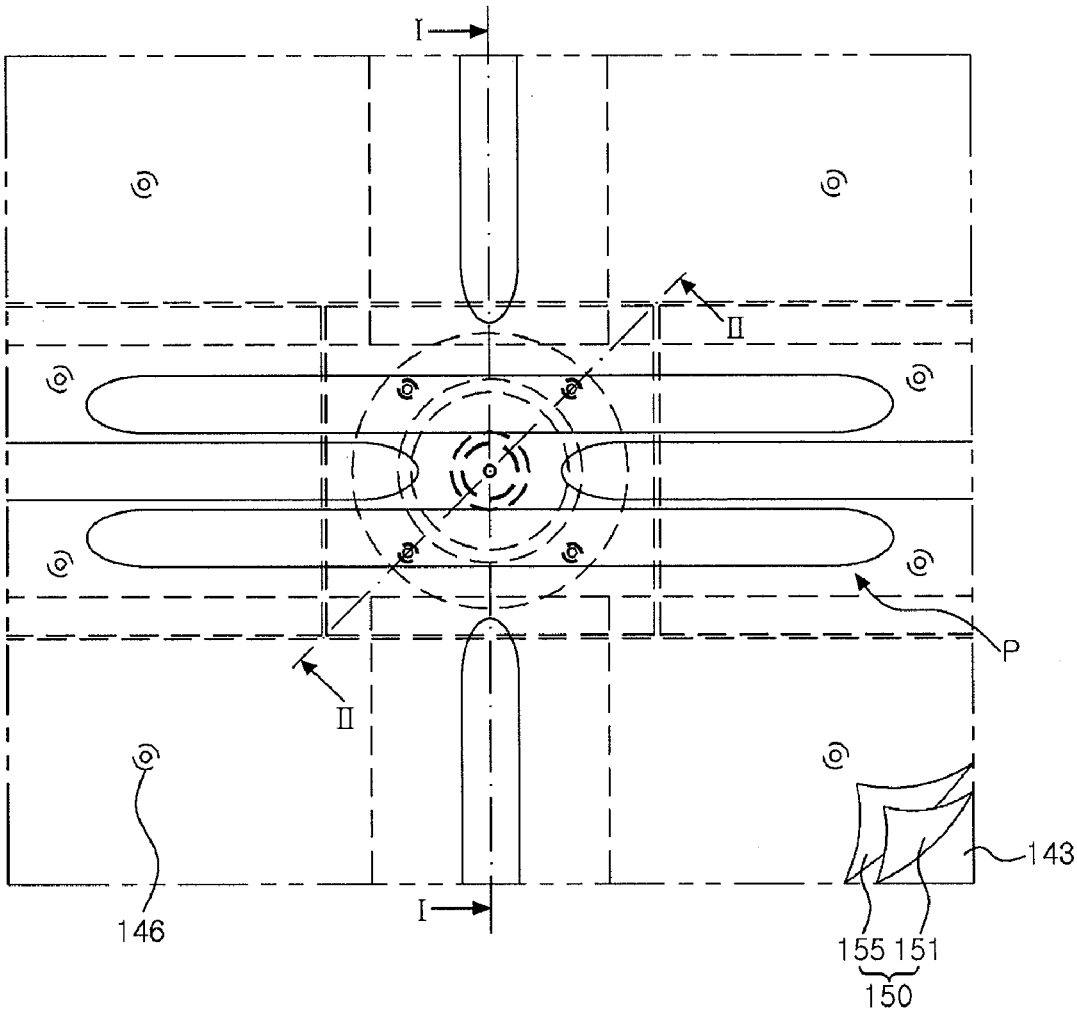
FIG. 4 is a plan view showing in detail a portion of the liquefied natural gas storage tank according to an embodiment of the present invention.
Figure 5:
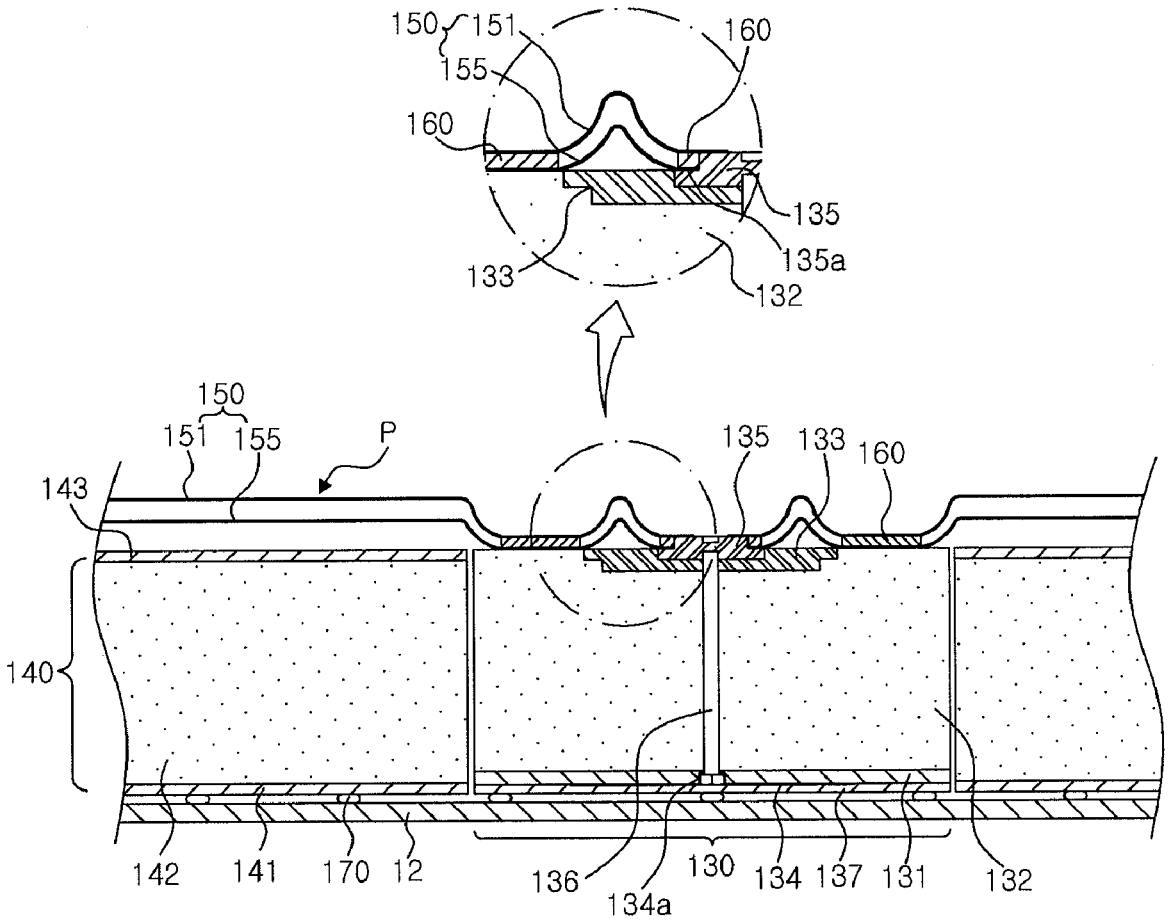
FIG. 5 is a sectional view taken along line I-I of FIG. 4.
Figure 6:
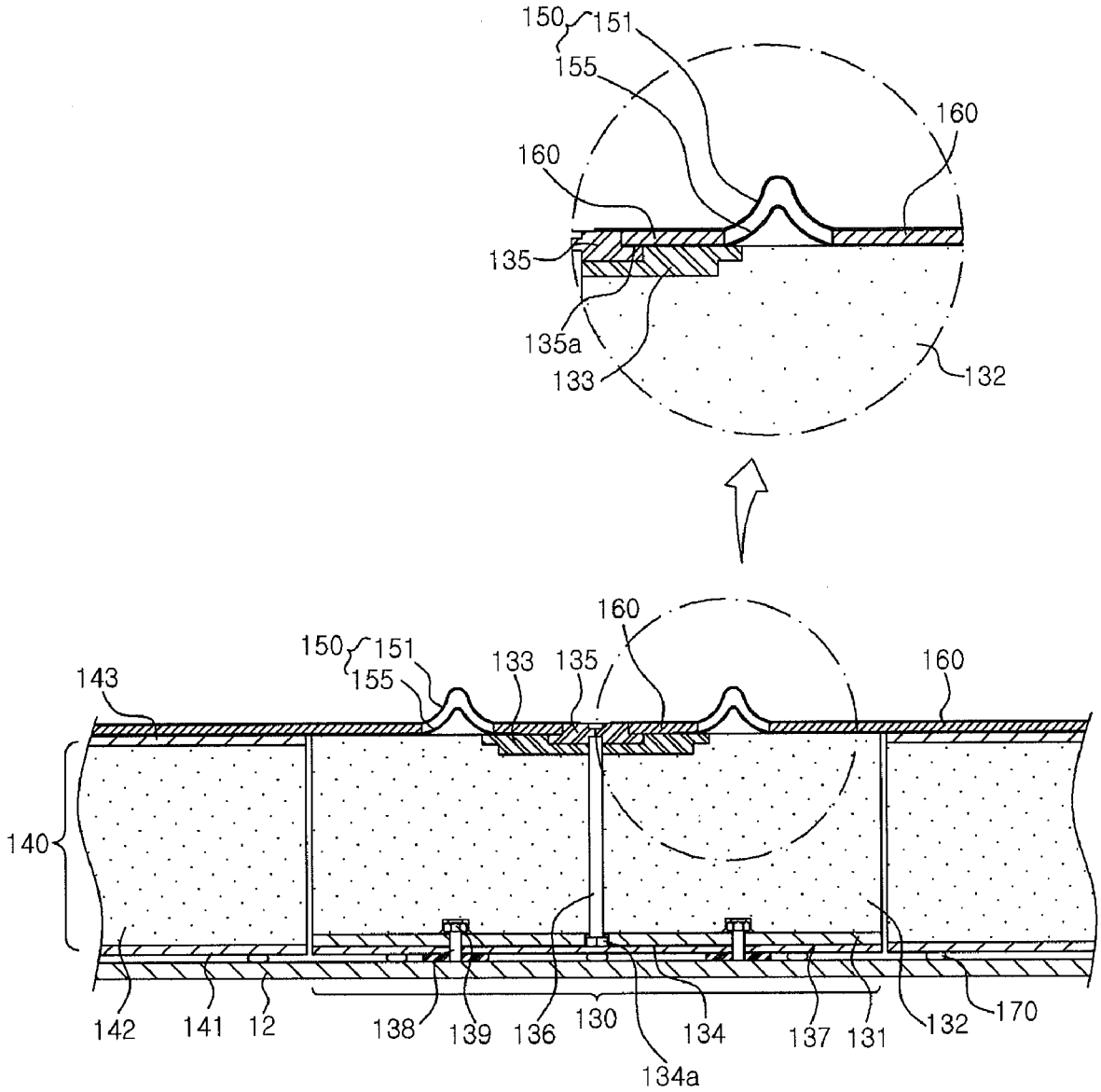
FIG. 6 is a sectional view taken along line II-II of FIG. 4.

FIG. 4 is a plan view showing in detail a portion of the liquefied natural gas storage tank according to an embodiment of the present invention, FIG. 5 is a sectional view taken along line I-I of FIG. 4, and FIG. 6 is a sectional view taken along line II-II of FIG. 4. As shown in FIGS. 4 to 6, the liquefied natural gas storage tank 10 according to an embodiment of the present invention is configured such that the insulation wall structures 120, 130 and 140 (in FIG. 2) constitute an insulation wall for insulating the storage tank 10 from the outside. The corner structures 120 and the anchor structures 130 are fixedly installed on a floor surface of the tank, and the planar structures 140 are installed between the corner structures 120 or between anchor structures 130 such that the planar structures can be slightly moved. To this end, each of the planar structures 140 is provided between the corner structures 120 or between the anchor structures 130 (not shown) through a plurality of connecting means 146. The connecting means 146 is constituted by coupling a plywood plate (a planar lower plate 141), which is a lower board of the planar structure, with a stud bolt 138 welded to the inner wall 12 of the hull, by means of a nut 139. A certain gap (about 1-about 4 mm) can be formed between the planar structure 140 and the corner structure 120 or between the planar structure and the anchor structure 130. This gap may be a space in which the planar structure 140 can be moved when the hull is deformed, so that it can accommodate the amount of deformation of the hull. Accordingly, the planar structure 140 can be slid slightly with respect to the floor surface in a horizontal direction.

The planar structure 140 comprises a planar lower plate 141 having face-to-face contact with the inner wall 12, a planar insulation 142 and a planar upper plate 143 formed on the planar insulation. Here, the planar lower and upper plates 141 and 143 are made of a plywood material, while the planar insulation 142 is made of polyurethane foam or reinforced polyurethane foam.

In the illustrated embodiment, each of the anchor structures 130 comprises a lower anchor plate 131, anchor insulation 132 formed on the lower anchor plate 131 and made of polyurethane foam or reinforced polyurethane foam, and an upper anchor plate 133 coupled onto the upper side of the anchor insulation.

The lower anchor plate 131 is mechanically secured to the inner wall 12. To this end, the plurality of stud pins 138 are installed on the inner wall 12 at regular intervals and an anchor base plate 137 with penetrating portions corresponding to the stud pins is coupled with the stud pins 138. The lower anchor plate 131 is mechanically secured to the inner wall 12 by means of the nuts 139 coupled with the stud pins 138. The anchor lower plate 131 is installed on the anchor base plate 137, a predetermined recessed space is formed at a central portion of the anchor lower plate 131, and a rod support cap 134 is installed in the recessed space. The rod support cap 134 may be provided with a nut 134*a* or formed integrally with a nut structure. The aforementioned anchor support rod 136 is coupled vertically with the rod support cap 134. To this end, the rod support cap 134 has a cap section provided with the nut 134*a* and a flange section extending radially from a lower end of the cap section. In addition, the flange section is interposed between the corresponding stud pins 138 and nuts 139 such that the flange section can be further secured. A lower structure of the anchor support rod 136 may be the same as those disclosed in Korean Patent Nos. 499711 and 499713.

In addition, the anchor insulation 132 made of polyurethane foam or reinforced polyurethane foam is inserted around the anchor support rod 136 and then placed on the lower anchor plate 131. The upper anchor plate 133 is fixedly attached to an upper surface of the anchor insulation 132 through which the anchor support rod 136 is inserted. And, a coupler or upper cap 135, which forms the interior sealing wall along with the first layer and the second layer, is placed at a central portion of the upper anchor plate 133 and then coupled to an upper end of the anchor support rod 136.

In the illustrated embodiment, the sealing wall 150 contacting the liquefied natural gas is installed on the insulation wall structures 130 and 140. Further, the walls of the sealing wall 150 are fixedly welded to one side of the upper cap 135. The layers of the sealing wall 150 also have a plurality of corrugated portions P (convex portions in the figures) which are formed on the wall to prevent the sealing wall from being damaged when the sealing wall layers are contracted or expanded by the temperature change or motion of the insulation wall structures.

Here, the sealing wall 150 may have a multiple-layer structure in which the plurality of sealing wall layers are stacked one above another. Preferably, the sealing wall has a dual-layer structure comprising the first and second sealing wall layers 151 and 155. That is, the sealing wall 150 comprises the second sealing wall layer 155 placed on the insulation wall structures 130 and 140 and the first sealing wall layer 151 installed over the second sealing wall layer 155, and the first and second sealing wall layers 151 and 155 are fixedly welded to the upper cap 135. To this end, a step portion 135*a* corresponding to the height of the sealing wall 150 may be formed at the upper cap 135 and the first and second sealing wall layers 151 and 155 are fixedly welded to the step portion 135*a*. That is, the second sealing wall layer 155 is fixedly welded to a lower end of the step portion 135*a* and the first sealing wall layer 151 is fixedly welded to an upper end of the step portion 135*a*. As described above, since a distance between the first and second sealing wall layers 151 and 155 is kept constant due to the step portion 135*a*, mechanical stress caused by the interference between the two sealing wall layers is not generated.

As described above, the insulation walls 120, 130 and 140 are formed through the combination of the corner structures 120, the anchor structures 130 and the planar structures 140 which will become insulation walls. In addition, the fabrication method, shape and material of the insulation wall disclosed in U.S. Pat. Nos. 4,747,513, 5,501,359, 5,586,513 and 6,035,795, PCT International Publication WO 89/09909, Japanese Patent Laid-Open Publication Nos. 2000-038190 and 2001-122386 may be used, and all of the publications are incorporated herein by reference. An embodiment of the present invention can employ an insulation wall and timber to be attached which are disclosed in the aforementioned patents. Although it has been described in the embodiment of the present invention that the anchor structure 130 is mechanically fixed to the inner wall 12 of the hull 1, the anchor structure may be fixed to the inner wall 12 by welding the anchor support rod 136 directly to the inner wall 12. In addition, a lower structure of the anchor structure 130 may be provided by using the structure disclosed in detail in Korean Patent Nos. 499711 and 499713.

In the meantime, the sealing wall 150 can be slightly expanded and contracted according to the temperature change. In such a case, the first and second sealing wall layers 151 and 155 may be damaged by their mutual contact, and thus, it is preferable to provide the structure in which the walls do not contact each other. To this end, a supporting board or spacer 160 is installed between the first and second sealing wall layers 151 and 155 such that a spaced distance between the two walls can be kept constant.

At this time, the supporting board or substance 160 is preferably provided over all the regions of the sealing wall 150 except the corrugated portions. In an embodiment, the supporting board 160 may be provided over a portion of the regions of the sealing wall. In certain embodiments, the supporting board 160 is formed of any material that can substantially maintain the distance between the first layer and the second layer. In one embodiment, the supporting board 160 may be formed of a material selected from the group consisting of plywood, polyurethane foam (or reinforced polyurethane foam), and a composite material in which plywood is bonded to at least one of top and bottom surfaces of polyurethane foam (or reinforced polyurethane foam).

As described above, since the first and second sealing wall layers 151 and 155 are spaced apart from each other, the temperature of the second sealing wall layer 155 can be kept higher than the temperature of the first sealing wall layer 151 in direct contact with the cryogenic liquefied natural gas. Therefore, since the durability of the second sealing wall layer 155 is enhanced, the life of the second sealing wall layer 155 may be longer than that of the first sealing wall layer 151.

Further, even though the hull and thus the storage tank are deformed due to waves, no direct friction occurs between the first and second sealing wall layers. Further, even though damage occurs on any one of the sealing wall layers due to impact applied thereto, it is possible to prevent the damage from being propagating directly to the other sealing wall layer. Furthermore, reference numeral "170" indicates a leveling material, which is placed between the inner wall 12 of the hull 1 and the bottom surface of the insulation wall structure at the time of installing the insulation wall structure such that the insulation wall structure can be kept at a constant height with respect to the inner wall 12.

Although it has been described in one embodiment of the present invention that first and second layers of the sealing wall are made of corrugated stainless steel for use in a GTT Mark-III type, invar steel for use in GTT No. 96 is also applicable. In certain embodiment, the first and second layers can be formed of any metallic material. Further, the sealing wall layers made of invar steel can be closely installed in a multiple-layer structure, and thus, the same effect as when the sealing member is made of stainless steel can be obtained.

As described above, the liquefied natural gas storage tank having an improved insulation structure according to embodiments of the present invention is configured to comprise an insulation wall and sealing wall layers of a multiple-layer structure, i.e. a dual-layer sealing wall structure. The configuration of the storage tank according to embodiments can be simplified, the sealing reliability can be increased, the assembling work for the tank can also be easily made, and the sealing reliability can be increased. Further, there is an advantage in that an installation structure of the storage tank installed in a ship for transporting liquefied natural gas in a cryogenic liquid state can be further simplified to thereby reducing an assembling process.

Although embodiments of the present invention has been described in connection with the accompanying drawings, the present invention is not limited thereto and it is apparent to those skilled in the art that various modifications and changes can be made thereto without departing from the spirit and scope of the invention.

What is claimed is:

1. A liquid tank, comprising:

an interior wall defining a space for containing a liquid, the interior wall comprising a first layer and a second layer opposing the first layer, a wrinkled portion, a non-wrinkled portion, and a coupler, the coupler having first and second surfaces spaced a predetermined distance from each other, wherein the first layer is configured to contact the liquid, and wherein the first layer of the wrinkled portion is coupled to the first surface and the second layer of the wrinkled portion is coupled to the second surface such that the first and second layers of the wrinkled portion are separated by the predetermined distance;

an exterior wall; and an intermediate wall interposed between the interior wall and the exterior wall;

wherein the non-wrinkled portion further comprises a spacer contacting both the first and second layers, and wherein the spacer is substantially hard such that the spacer substantially maintains a distance between the first and second layers of the non-wrinkled portion; and wherein the wrinkled portion comprises a first wrinkle in the first layer and a second wrinkle in the second layer, wherein the first and second wrinkles are opposing each other.

2. The liquid tank of claim 1, wherein the first and second layers do not contact each other.

3. The liquid tank of claim 1, wherein the first wrinkle is configured to allow deformation of the first layer.

4. The liquid tank of claim 1, wherein the first layer is configured to shrink, upon contacting the liquid, and wherein the first wrinkle is configured to be stretched when the first layer is shrunk.

5. The liquid tank of claim 1, wherein the spacer is movable relative to at least one of the first layer and the second layer while contacting the first layer and the second layer.

6. The liquid tank of claim 1, wherein the wrinkled portion is substantially free of a substance between the first and second wrinkles that inhibits deformation of the wrinkled portion.

7. The liquid tank of claim 1, wherein the first and second layers are generally separated by the predetermined distance throughout the first and second wrinkles.

8. The liquid tank of claim 1, wherein the first wrinkle substantially receives the second wrinkle.

9. The liquid tank of claim 1, wherein the wrinkled portion is elongated, wherein the first and second wrinkles extends in a longitudinal direction of the wrinkled portion.

10. The liquid tank of claim 1, wherein the first and second layers are generally inversely curved in the first and second wrinkles.

11. The liquid tank of claim 1, wherein the first layer of the wrinkled portion and the first layer of the non-wrinkled portion are sealed in a liquid tight manner and wherein the second layer of the wrinkled portion and the second layer of the non-wrinkled portion sealed in a liquid tight manner.

12. The liquid tank of claim 1, wherein the spacer is configured to substantially insulate heat transfer between the first layer and the second layer.

13. The liquid tank of claim 1, wherein the exterior wall comprises a structure of a ship, and wherein the liquid tank is integrated with the ship.

14. The liquid tank of claim 1, wherein the liquid tank is integrated with a ground transportation vehicle.

15. The liquid tank of claim 1, wherein the first layer and the second layer and the coupler are sealed in a liquid tight manner.

16. The liquid tank of claim 15, wherein the wrinkled portion and the coupler are sealed in a liquid tight manner, wherein the wrinkled portion comprises a spacer between the first and second layers, and wherein the wrinkled portion is coupled to the coupler.

17. The liquid tank of claim 15, wherein the coupler is configured to contact the liquid.

18. The liquid tank of claim 15, wherein the first layer extends over the coupler, wherein the second layer is lacking where the coupler is formed.

19. The liquid tank of claim 15, wherein the interior wall further comprises at least one additional wrinkled portion, each of which is coupled with the coupler in a liquid tight manner.

20. The liquid tank of claim 15, further comprising an anchor contacting and secured to both the interior wall and the exterior wall, wherein the anchor contacts and is secured to the coupler of the interior wall.

21. The liquid tank of claim 20, wherein the intermediate wall comprises an anchored portion and a non-anchored portion, wherein the anchored portion contacts the anchor and is integral with the anchor, wherein the non-anchored portion does not contact the anchor.

22. The liquid tank of claim 21, wherein the anchored portion contacts and is secured to the coupler of the interior wall and the exterior wall.

23. The liquid tank of claim 21, wherein the non-anchored portion is slidably inserted between the interior wall and the exterior wall.

24. The liquid tank of claim 21, wherein the non-anchored portion is not fixed either of the interior wall and the exterior wall.

* * * * *